US005458241A

United States Patent [19]

Brown

[11] Patent Number: 5,458,241

[45] Date of Patent: Oct. 17, 1995

[54] STORAGE DEVICE FOR DECORATIVE LIGHT STRING

[75] Inventor: Peter A. Brown, Lubbock, Tex.

[73] Assignee: Gary Products Group, Inc., Lubbock, Tex.

[21] Appl. No.: 300,324

[22] Filed: Sep. 2, 1994

[51] Int. Cl.[6] ..... B65D 85/04

[52] U.S. Cl. ..... 206/419; 242/405.2

[58] Field of Search ..... 206/418, 419, 206/420, 421, 422; 242/405.1, 405.2, 407, 602.1, 613.3

[56] References Cited

U.S. PATENT DOCUMENTS

| | | | |
|---|---|---|---|
| 2,984,347 | 5/1961 | Kalinchuk | 206/419 |
| 3,626,495 | 12/1971 | Bastian, Jr. | 242/405.2 |
| 4,123,012 | 10/1978 | Hough | 242/405.2 |
| 4,177,961 | 12/1979 | Gruenewald | 242/405.2 |
| 4,261,529 | 4/1981 | Sandberg | 242/85.1 |
| 4,586,675 | 5/1986 | Brown | 242/85.1 |
| 4,778,125 | 10/1988 | Hu | 242/405.2 |
| 4,917,323 | 4/1990 | Wing | 242/96 |
| 4,971,200 | 11/1990 | Huang et al. | 206/420 |
| 5,064,067 | 11/1991 | McAllister et al. | 206/420 |
| 5,168,999 | 12/1992 | Lee et al. | 206/420 |

*Primary Examiner*—Jimmy G. Foster
*Attorney, Agent, or Firm*—Ross, Clapp, Korn & Montgomery

[57] ABSTRACT

An integrally molded plastic device for supporting and storing elongated strands such as decorative light strings, the frame comprising integral cord winding members, cooperatively aligned hook and slot-containing members, electrical plug retention members, and a centrally disposed handgrip member.

5 Claims, 2 Drawing Sheets

STORAGE DEVICE FOR DECORATIVE LIGHT STRING

BACKGROUND OF THE INVENTION

1. Field of the Invention

This invention relates to a molded plastic device around which strings of decorative lights such as Christmas lights can be wrapped for storage.

2. Description of Related Art

Decorative light packages typically comprise plastic frames such as those disclosed, for example, in U.S. Pat. Nos. 4,971,200 and 5,168,999, that support the decorative bulb and socket assemblies of decorative light strings in aligned rows, with the connecting wires folded therebetween. Such frames are inserted into cardboard boxes or sleeves at the factory. It is often a difficult and time-consuming task to reinsert the decorative light strings back into the original packaging modules for storage following use. Because of this, such light strings are frequently coiled up and placed into boxes or bags, where they can become tangled, causing difficulty when they are subsequently reused.

Various devices have previously been disclosed for use in storing decorative light strings that are easier to work with than the original packaging and are intended to reduce the likelihood of tangling. Such devices are disclosed, for example, in U.S. Pat. Nos. 4,261,529; 4,586,675; 4,917,323 and 5,064,067.

SUMMARY OF THE INVENTION

According to a preferred embodiment of the invention, a device is provided that is particularly useful for the secondary storage of decorative light strings, the device comprising integrally molded frame, hook, slot-containing, handgrip and plug retention members. As used herein, the term "secondary storage" refers to the use of means other than OEM packaging for retaining elongate strands such as, for example, decorative light strings once they are removed from display.

The frame member of the subject device preferably comprises elongated side support members interconnected by spaced-apart transverse members, the transverse members being recessed inwardly from the respective ends of the frame member to facilitate winding a decorative light string around the transverse members between the elongated side support members. The hook members of one decorative light storage device of the invention desirably interlock with the slot-containing members from another such device for use in suspending one from another. The plug retention members are preferably adapted by means of cooperating rectangular slots and cylindrical bores for receiving and maintaining either European or American style plugs.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
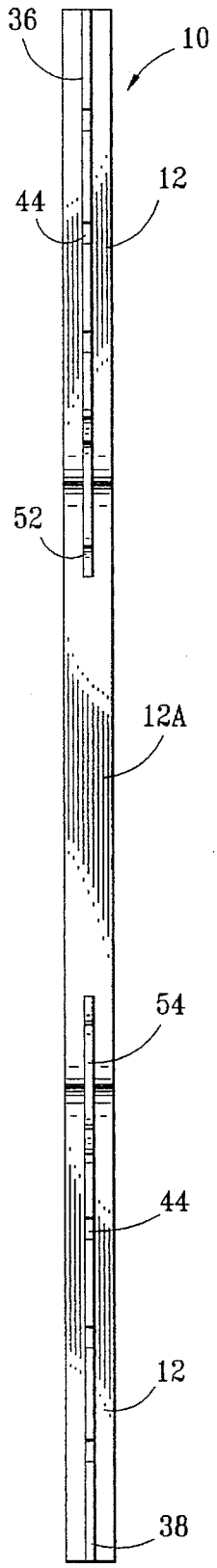
FIG. 1 is a left side elevation view of a preferred decorative light storage device of the invention.

Referring to FIGS. 1–4 of the invention, decorative light storage device 10 preferably comprises a frame having two substantially parallel, elongated side support members interconnected by a plurality of laterally extending transverse members. Although numerous constituent subparts of device 10 are separately identified and referred to herein, it should be understood that according to the best mode of the invention as known to the applicant as of the date of filing of this application, device 10 is integrally molded from a thermoplastic material, most preferably injection molded polypropylene.

One elongated side support member of device 10 is generally defined by segments 12 as interconnected by intermediate segments 12A and 12B. The other elongated side support member of device 10 is generally defined by segments 32, 14 and 34 as interconnected by web sections 24, 28. Web sections 24, 28 preferably further comprise hook members 26, 30 that are useful for interlocking one decorative light storage device 10 with another as described below in relation to FIGS. 2 and 4–7. Laterally extending transverse member 16 interconnects segment 12 with segment 32. Laterally extending transverse member 18 interconnects segment 12B with segments 32, 14, and with web section 24. Laterally extending transverse member 20 interconnects segment 12B with segments 14, 34, and with web section 28. Laterally extending transverse member 22 interconnects segment 12 with segment 34. Segment 12B preferably further comprises handgrip member 40 adjacent space 42.

Figure 2:
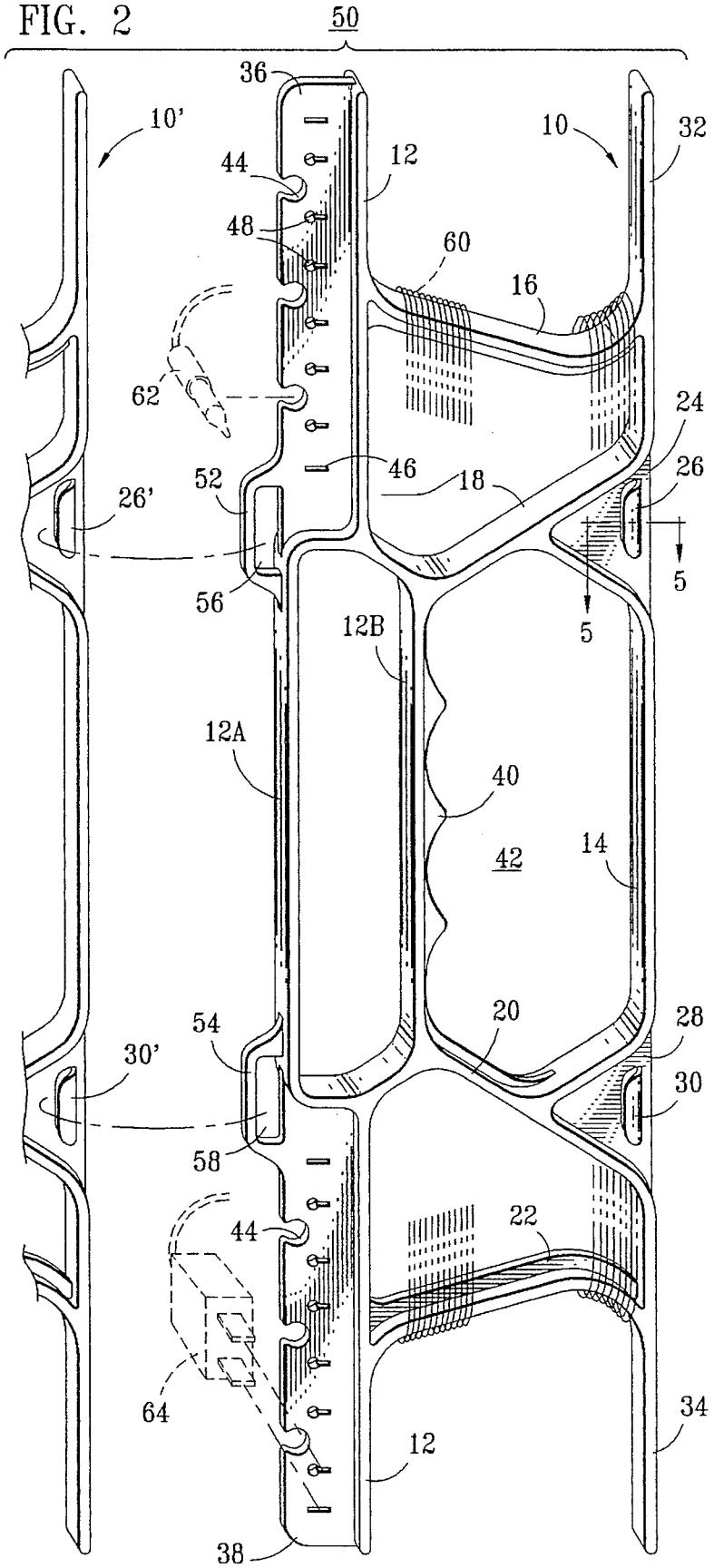
FIG. 2 is a front elevation view of a preferred decorative light storage device of the invention, further depicting in spaced-apart relation a broken-away section of another such storage device in proximity to the first storage device and aligned so as to facilitate interlocking the two devices.
Figure 3:
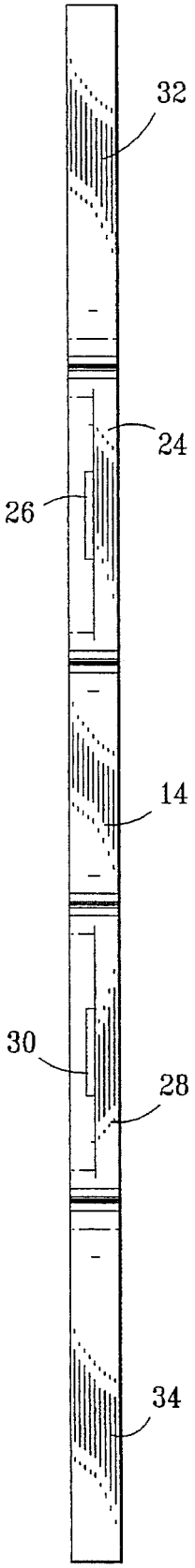
FIG. 3 is a right side elevation view of a preferred decorative light storage device of the invention.
Figure 4:
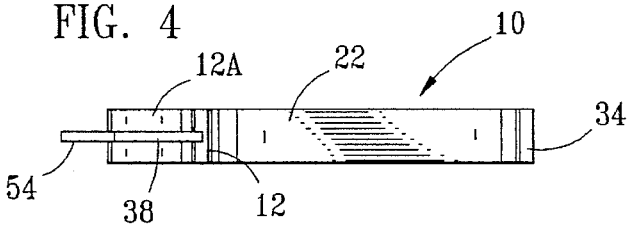
FIG. 4 is a bottom view of a preferred decorative light storage device of the invention.

Laterally extending transverse members 16, 22 are desirably recessed from the respective ends of the frame member and disposed obliquely rather than horizontally between the elongated side support members to facilitate orderly wrapping of an elongated strand, preferably one or more decorative light strings, around decorative light storage device 10, as illustrated by electrical cord 60 shown in phantom outline in FIG. 2.

Plug retention members 36, 38 are desirably provided along the side of segments 12 opposite transverse members 16, 22 at the respective ends of segment 12A, and preferably further comprise a plurality of openings 48 having cooperating rectangular slots and cylindrical bores for receiving and maintaining either European style (cylindrical prongs) or American style (rectangular prongs) plugs, as exemplified by plug 64 shown in phantom outline in FIG. 2. One or more recesses 44 are desirably provided for use in frictionally engaging and supporting the free end(s) of decorative light strings that have one end terminating with a bulb and socket assembly.

Figure 5:
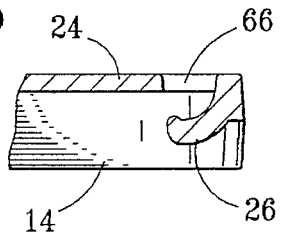
FIG. 5 is a detail view, partially in section, taken along line 5—5 of FIG. 2.
Figure 6:
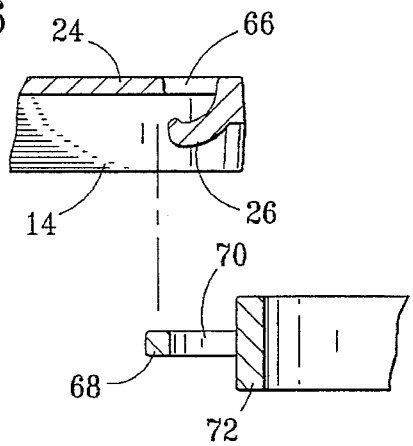
FIG. 6 is a detail view, partially in section, of aligned hook and slot-containing portions of two preferred decorative light storage devices prior to interconnection.
Figure 7:
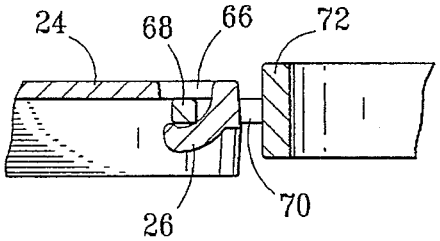
FIG. 7 is a detail view, partially in section, of interconnected hook and slot-containing portions of two preferred decorative light storage devices of the invention.

Slot-containing members 52, 54 defining slots 56, 58, respectively, are preferably attached to segment 12A and to plug retention members 36, 38, respectively, in spaced-apart relation that corresponds to the spacing between hook members 26, 30. Slots 56, 58 are desirably slightly larger than the size of hooks 26, 30 so that slot-containing members 52, 54 can receive hook members 26', 30' whenever two or more decorative light storage devices as shown by devices 10, 10' in FIG. 2 are interlocked to form a decorative light storage unit 50. FIGS. 5–7 further illustrate how hook member 26 of one decorative light storage device of the invention can be aligned with a slot-containing member 68 (like slot-containing member 52 of device 10) in another such device so that hook member 26 can be inserted into and through slot 70 to interlock the two devices and thereby suspend one from another if, for example, segment 12A is placed over a hook, nail or other means of support. Space 66 behind hook member 26 as shown in FIGS. 5–7 is desirably provided in web section 24 to facilitate molding of the part. Slot-containing members 52, 54 also cooperate with segments 12A, 12B and handgrip member 40 to permit the user to hold decorative light storage device 10 while wrapping one or more decorative light strings around the frame member for storage.

Although the invention is disclosed herein in relation to its preferred embodiment, other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled. Thus, for example, if it is desired to mold only one plug retention member (such as plug retention member 36 shown in FIGS. 1 and 2) segment 12A can be lengthened to permit attachment of both ends of slot-containing member 54 to segment 12A, and plug retention member 3 8 can then be eliminated within the scope of the invention.

I claim:

1. A secondary storage device for decorative light strings comprising a frame member having integrally molded therewith at least two spaced-apart hook members, at least two spaced-apart slot-containing members aligned with the hook members, a handgrip member and at least one plug retention member;

the frame member further comprising elongated side support members interconnected by spaced-apart transverse members, the transverse members being recessed inwardly from the respective ends of the frame member.

2. The secondary storage device of claim 1 wherein the transverse members extend obliquely between the elongated side support members.

3. The secondary storage device of claim 1 wherein the plug retention member comprises an array of openings consisting of both rectangular slots and cylindrical bores sized to receive and frictionally engage either round or rectangular electrical plug prongs.

4. The secondary storage device of claim 1 wherein the hook members are each part of a separate web member connected to one of the elongated side support members.

5. The secondary storage device of claim 1 wherein each plug retention member further comprises a recess sized so as to frictionally engage a decorative bulb and socket assembly.

* * * * *